United States Patent [19]

Powers

[11] 4,221,400

[45] Sep. 9, 1980

[54] METHOD AND APPARATUS FOR SELECTIVELY ADJUSTING THE STIFFNESS OF A SKI

[76] Inventor: John T. Powers, Box 2573, Aspen, Colo. 81611

[21] Appl. No.: 958,933

[22] Filed: Nov. 8, 1978

[51] Int. Cl.[3] ..... A63C 5/07

[52] U.S. Cl. ..... 280/602

[58] Field of Search ..... 280/602, 601, 610; 272/66

[56] References Cited

U.S. PATENT DOCUMENTS

| | | | |
|---|---|---|---|
| 2,258,046 | 10/1941 | Clement | 280/602 |
| 2,918,293 | 12/1959 | Tavi | 280/602 |
| 3,300,226 | 1/1967 | Reed, Jr. | 280/602 |
| 3,862,755 | 1/1975 | Ogden | 272/66 |
| 3,894,745 | 7/1975 | Heim et al. | 280/610 |

FOREIGN PATENT DOCUMENTS

| | | | |
|---|---|---|---|
| 1118857 | 3/1956 | France | 280/602 |
| 1467141 | 12/1966 | France | 280/602 |
| 1526418 | 4/1968 | France | 280/602 |

*Primary Examiner*—John J. Love
*Assistant Examiner*—Milton L. Smith
*Attorney, Agent, or Firm*—Burton & Dorr

[57] ABSTRACT

Method and apparatus for selectively adjusting the stiffness of a ski using prestressed, curved rod members. The rod members are positioned lengthwise of the ski in bores and the stiffness of the ski can be selectively adjusted by rotating the rod members about their longitudinal axes. For a stiff ski, each rod member is rotated so that the prestressed curve faces upwardly and for a soft ski, each rod member is rotated so that the prestressed curve faces downwardly. By rotating the rod members between these extremes, intermediate degrees of stiffness can be obtained. One or more rod members can be used and when plural rod members are used, the stiffness of the ski can be adjusted both lengthwise and crosswise. Indicating means are provided for showing the rotational position of each rod. The rod members can be placed directly in drilled out bores in the ski, in drilled out bores of a housing which can then be inserted in the ski, or in tubes mounted within or atop the ski. The force of each rod member can be varied along its longitudinal axes if desired and one disclosed embodiment includes prestressed, curved hollow rod members about prestressed curved solid rod members whereby the hollow and solid rod members can be individually rotated to vary the ski's stiffness. The rod members can be disposed within or atop the main body of the ski and can be adapted to adjust the stiffness of any flexible body.

10 Claims, 15 Drawing Figures

7 Convex
9 Concave
11 Flat
13 Flat
180° 170° 160° 150° 140° 130° 120° 110° 100° 90° 80° 70° 60° 50° 40° 30° 20° 10° 0°

METHOD AND APPARATUS FOR SELECTIVELY ADJUSTING THE STIFFNESS OF A SKI

FIELD OF THE INVENTION

This invention relates to the field of apparatuses and methods for adjusting the stiffness of flexible bodies and more particularly to the field of apparatuses and methods for adjusting the stiffness of a ski.

BACKGROUND OF THE INVENTION AND PRIOR ART

Commercially available skis are built with an inherent stiffness that is not adjustable. Due to the high cost of skis, the vast majority of skiers can only afford one pair of skis and, consequently, they must decide at the time of purchase how stiff their skis are going to be. Unfortunately, skiing conditions vary widely from ski resort to ski resort, from ski run to ski run, from day to day during the season, and, indeed, from hour to hour during any day. Further, it is almost impossible to purchase skis with the correct stiffness based on the advice of others since a ski stiffness that is suited to one person's skiing style for a given snow condition may not be suited to another's style. All of these factors combine to make it extremely difficult to purchase skis with the right stiffness and as a result, one generally ends up purchasing skis whose stiffness is all right for practically all snow conditions but not exactly right for any particular snow condition and skiing style.

Experienced skiers recognize that skiing conditions at any one resort vary widely over the long periods (e.g., months) of a season so they often own two pairs of skis, a soft pair for powder and a stiffer pair for hard-packed. Such experienced skiers with two or more pairs of skis have the luxury of picking a particular pair to meet a particular day's conditions or because they wish to ski powder or hard-packed that day. However, if the day's conditions change (or if they misjudged the conditions) or if they wish to ski both powder and hard-packed in the same day, then they are stuck with the wrong ski stiffness for the conditions just like the single pair owners.

Skis with adjustable stiffness are contemplated to be an invaluable teaching tool for skiers of all ranges of ability. They are also envisioned as a great aid to skiers whose technique or body characteristics are not perfect. Such skis would be particularly valuable if their stiffness were adjustable lengthwise and crosswise whereby many common problems such as uneven boot cant, uneven strength distribution, and uneven weight distribution could be compensated for in each individual ski. It is quite common for professional skiers, especially ones who have had injuries, to have individual skis custom-built for each leg with each ski having its own stiffness and other performance characteristics. Skis with adjustable stiffness would be ideal for such professionals and, indeed, non-professionals alike.

Several skis with adjustable stiffness have been patented. Notably, U.S. Pat. No. 3,300,226 to Reed, Jr., issued on Jan. 24, 1967, French Pat. No. 1,526,418 to Vogel issued on May 19, 1967, French Pat. No. 1,467,141 to Guey et al issued on Dec. 13, 1965, U.S. Pat. No. 2,918,293 to Tavi issued on Dec. 22, 1959, U.S. Pat. No. 2,258,046 to Clement issued on Oct. 7, 1941, and French Pat. No. 1,118,857 to Michal et al issued on June 12, 1956. Reed and Vogel illustrate the concept of adjusting a ski's stiffness by the use of cylindrical members rotably mounted within bores that extend lengthwise of the ski. Each of the cylindrical members is composed of one or more flat metal, stiffening elements (Reed's member 22 and Vogel's members 2, 4, and 7) mounted in a cylindrical matrix of rubber or epoxy resin. When these flat metal, stiffening elements are disposed vertically, the skis are supposedly stiff and when they are horizontal, the skis are soft. Unfortunately, these two designs have several inherent structural drawbacks. Notably, when the flat metal, stiffening elements are aligned vertically, the ski is more than merely stiff, it is rigid with virtually no flexibility. A flat plate when it is placed edgewise against an applied force as when Reed's and Vogel's metal plates are vertical has virtually no flex. Needless to say, this is totally unacceptable to a skier and goes magnitudes beyond what a skier looks for even in the stiffest of skis. Further, the flexing force of the plates of Reed and Vogel when they are between their vertical and horizontal positions would be at best unpredictable. Finally, a ski flexes thousands of times during a run creating stresses and strains which would tend to tear, crack, and destroy any composite or laminated stiffening element such as Reed's or Vogel's which are composed of metal, rubber, and epoxy all of which have widely varying properties such as expansion and contraction coefficients, strength, flexibility, and the ability to handle stresses and strains. Vogel also teaches the broad idea of varying the stiffness of each of his stiffening elements from one end to the other by progressively diminishing the cross-sectional area of the element. This adds to the range over which he can adjust his stiffness characteristics.

Guey discloses a number of methods for adjusting a ski's stiffness. In the embodiment of his FIGS. 2–7, stiffening rods of circular, T-shaped, and wedge-shaped cross section are mounted lengthwise of the ski. The rods can be made of various materials such as steel, alloys, and plastic and the stiffness is varied by substituting a set of rods of one material for a set of rods of a softer or stiffer material. Guey's method is not much more desirable than owning two different pairs of skis since a skier cannot change the stiffness unless he returns home for a new set of rods or carries a second set with him. Even then, the second set may still be too soft or stiff and a third set needed. Guey's method at best only provides for gross and imprecise adjustments in stiffness. In Guey's embodiments of FIGS. 8–14, the ski has laminated layers which are selectively pulled together to stiffen the ski. Tavi illustrates a manner of adjusting a ski's stiffness by varying the tension on longitudinally extending wires 19. Michal varies his stiffness by adjusting the tension on the rods 2 and Clement varies his between two extremes by either loading or unloading spring 40 as illustrated in his FIGS. 9 and 10.

SUMMARY OF THE INVENTION

The present invention involves an apparatus and method for adjusting the stiffness of a flexible body such as a ski. In all of the embodiments of the invention, prestressed, curved rod members are positioned lengthwise of the ski within bores and rotated about their longitudinal axes to selectively adjust the stiffness of the ski. For a stiff ski, the rod members are rotated so that the prestressed curve faces upwardly. For a soft ski, the rod members are rotated so the curve faces downwardly. Intermediate degrees of stiffness can be obtained by rotating the rod members to positions inbetween these extremes. One or more prestressed, curved rod members can be used and when more than one is used, the stiffness of the ski can be varied not only lengthwise but also crosswise. In one embodiment, there is a prestressed, curved solid rod member that is inserted in a prestressed, curved hollow rod member which, like the solid rod member, is also rotatable to vary the ski's stiffness.

In the preferred embodiments, the rod members are positioned interiorly of the elongated, main body of the ski but they can be located atop the main body if desired. In one embodiment, the bores and rod members are placed directly in the main body of the ski and in a second embodiment, they are located in a housing which is positioned in the ski. The housing, bores, and rod members of this second embodiment form an adjustable stiffness unit that is particularly adaptable for use with any flexible body. Indicating means can be located on the rod members, housing, and skis adjacent the bores to indicate the rotational position of the rod members and the stiffness characteristics of the ski. The indicating means can be composed of single or plural markings placed on the ends of the rod members, housing, and ski. In one embodiment, the indicating means is composed of a substantially linear series of slots in fluid communication with each bore and a series of markings on each rod member. The two series intersect at an angle and different markings align with different slots as the rod member is rotated within the bore. In the preferred embodiments, the rod members have a slot in one end and are rotated by inserting a rotating tool such as a screw driver into the slot and turning the tool. Means are also disclosed for selectively securing each of the rod members in any one of its rotational positions.

If desired, the stiffness characteristics of the ski can be very finely adjusted by using prestressed, curved rod members whose force varies along the longitudinal axis of the rod member. For example, the force can progressively increase along the longitudinal axis or can increase along one portion of the axis and decrease along a second portion. In this manner, the overall stiffness of the ski can be adjusted while still maintaining one portion of it such as the tail stiffer than another portion such as the tip or middle. In all of the preferred embodiments, the rod members extend lengthwise of the flexible body because the preferred embodiments are associated with skis but the rod members could be positioned crosswise if desired as, for example, in a diving board or both lengthwise and crosswise.

OBJECTS OF THE INVENTION

It is an object of this invention to provide a new and novel method and apparatus for adjusting the stiffness of a flexible body such as a ski using prestressed, curved rod members.

It is an object of this invention to provide a new and novel method and apparatus for selectively adjusting the stiffness of a ski both lengthwise and crosswise using prestressed, curved rod members.

Another object is to provide a new and novel method and apparatus for adjusting the stiffness of a ski and providing readibly visible indicating means so that the skier can tell the stiffness of his ski.

Another object is to provide a new and novel adjustable stiffness unit composed of a housing with bores containing prestressed, curved rod members whereby the unit can be employed to adjust the stiffness of a flexible body such as a ski.

Additional objects as well as features and advantages of this invention will become evident from the descriptions set forth hereinafter when considered in conjunction with the accompanying drawings.

BRIEF DESCRIPTION OF THE DRAWINGS

FIG. 3 also illustrates one manner in which each rod member can be selectively held in any preferred rotational position by the use of set screws.

FIG. 13 also shows in dotted lines that the ends of the rod members can extend rearwardly to be flush with the tail end of the ski.

DETAILED DESCRIPTION OF THE PREFERRED EMBODIMENTS

Figure 1:
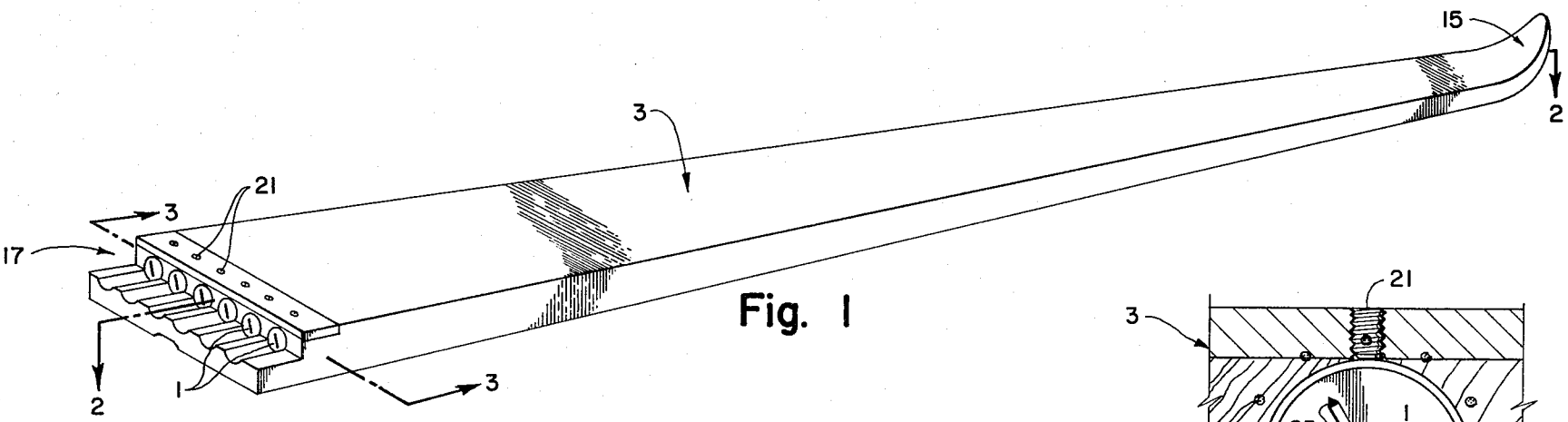
FIG. 1 is a perspective view of one embodiment of the invention in which the prestressed, curved rod members are inserted within bores extending lengthwise of the ski.
Figure 2:
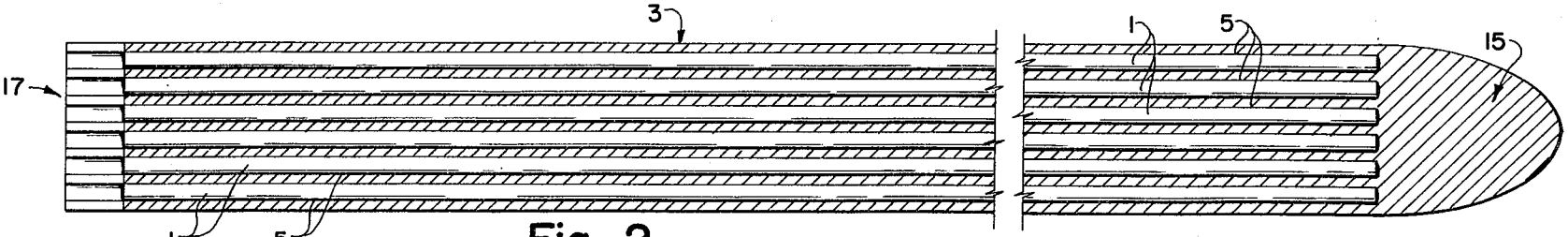
FIG. 2 is a sectional view along the line 2—2 of FIG. 1 illustrating the placement of the rod members within the ski.
Figures 5, 6, 7, 8, 9, 10, 11:
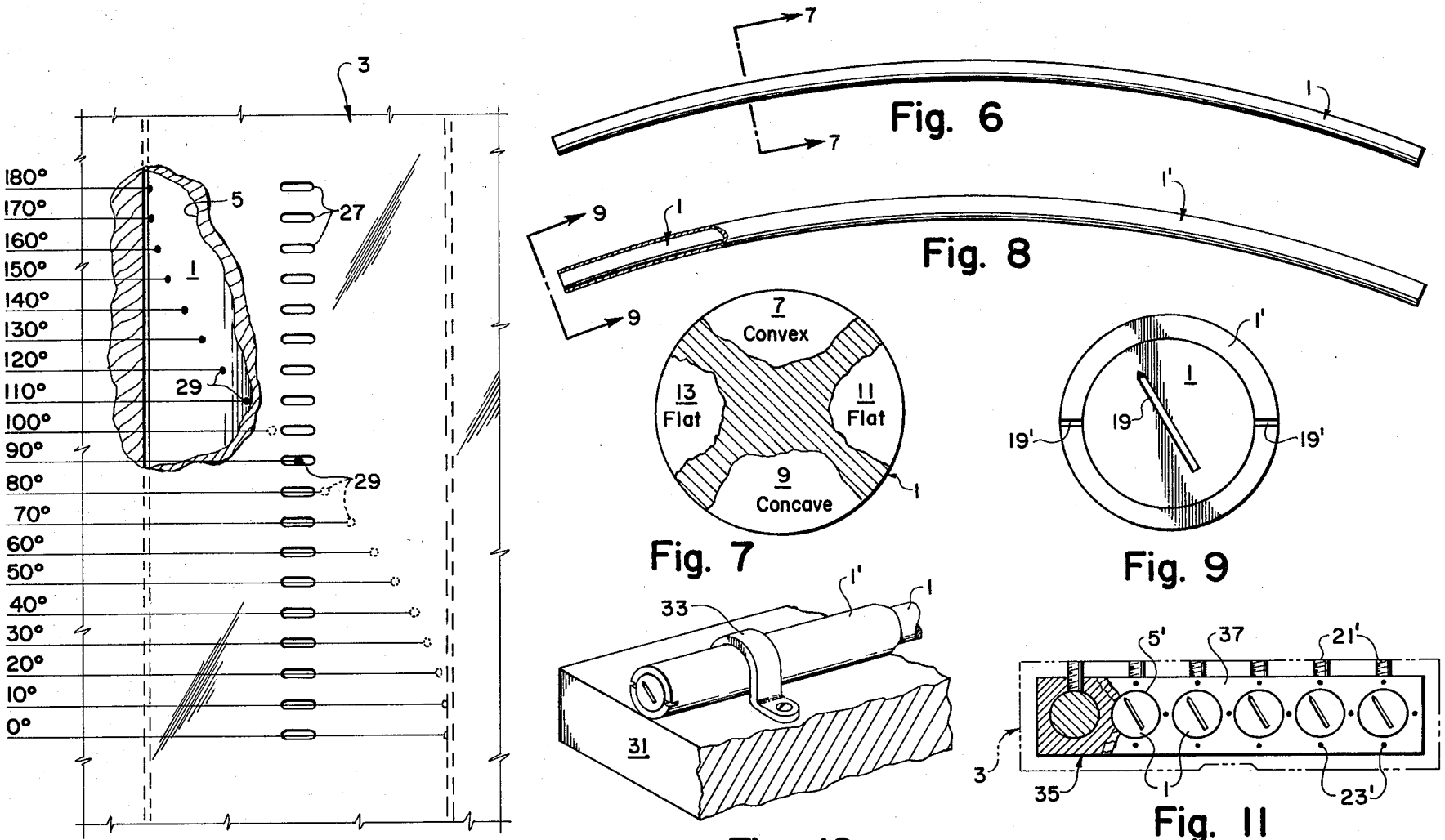
FIG. 5 illustrates a second way in which the rotational position of each rod member can be indicated. In this embodiment, an intersecting series of slots extending into the bore and a series of markings on the rod member within the bore are provided whereby at least one of the slots and markings will align as the rod member is rotated within the bore.
FIG. 6 is a side view of one of the prestressed, curved rod members of the preferred embodiment illustrating its natural arched or bowed shape that it assumes when it is out of the bore.
FIG. 7 is a view along line 7—7 illustrating the convex, concave, and flat sections of each rod member.
FIG. 8 is a side view of a second embodiment of the invention in which the solid rod member of FIG. 6 is positioned within a prestressed, curved rod member that is hollow. In this embodiment, both the hollow and solid rod members can be individually rotated to vary the ski's stiffness.
FIG. 9 is a view along 9—9 of FIG. 8 illustrating the manner in which the hollow and solid rod members can be individually rotated about their longitudinal axes to vary the ski stiffness.
FIG. 10 illustrates another embodiment in which the rod members are positioned atop the main body of the ski rather than within bores extending along the length of the ski's main body.
FIG. 11 illustrates in solid lines how the rod members of the present invention can be placed in a housing to form an adjustable stiffness unit. This unit can then be placed within any flexible body such as a ski as shown in dotted lines in FIG. 11 or adjacent thereto to selectively adjust the stiffness of the flexible body.

The preferred method and apparatus of the present invention use prestressed, curved rod members 1 to selectively adjust the stiffness of a flexible body such as the ski 3 of FIG. 1. The rod members 1 are inserted within bores 5 which extend lengthwise of the ski 3 as illustrated in FIG. 2. The prestressed, curved rod members 1 of the preferred embodiments have a natural arched or bowed shape which they assume when out of the bores 5 as best seen in FIG. 6. In relation to the longitudinal axis of each rod member 1, there is a convex section 7, concave section 9, and two flat sections 11 and 13 as shown in FIG. 7.

Figure 3:
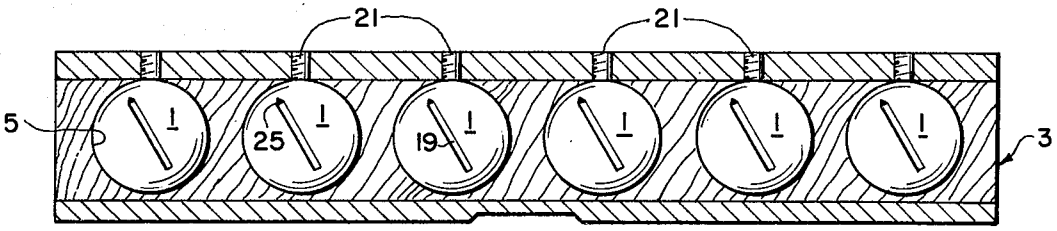
FIG. 3 is an end view along line 3—3 of FIG. 1 showing one manner in which each rod member can be selectively rotated about its longitudinal axis by providing a slot in its end into which a screwdriver or other rotating tool can be inserted.

The cross-sectional shape of the rod members 1 and bores 5 is preferably circular and the rod members 1 are received within the bores 5 for rotation about their respective longitudinal axes as illustrated in FIG. 3. The ski 3 has a forward end or tip 15 and a rearward end or tail 17. One end of each rod member 1 is visible and accessible from the rearward end 17 of ski 3 as shown in FIGS. 1 and 3 and is provided with a slot 19 for receiving a screwdriver or other tool whereby rotation of the screwdriver can be translated to rotation of the rod member 1 within the bore 5. Set screws 21 are provided for selectively securing each rod member 1 in any one of its rotational positions.

Figure 4:
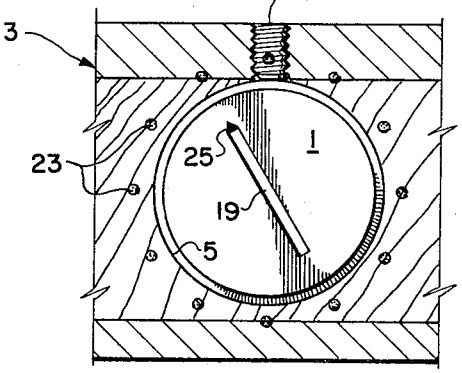
FIG. 4 illustrates one way in which the rotational position of each rod member within its bore can be indicated at the tail of the ski by providing indicating dots or markings about that end of the bore and providing the slot in that end of the rod member with an arrowhead.

In the embodiment of FIG. 4, indicating means are provided so that the rotational position of each rod member 1 can be determined at a glance. Indicating marks or dots 23 are positioned on the rearward end 17 of the ski 3 about each bore 5 and each turning slot 19 is provided with an arrowhead 25 at one end. The arrowhead 25 points toward the convex section 7 of each rod member 1 or up in FIG. 6. When all of the arrowheads 25 point up in FIG. 3, the ski 3 will be at its stiffest. When all of the arrowheads 25 point downwardly, the ski 3 will be at its softest. Intermediate degrees of stiffness can be obtained by rotating the rod members 1 between these extremes. The arrowheads 25 are needed because each rod member 1 is prestressed into a curved shape and consequently, never exhibits the same force characteristics during a rotation of 360° within the bore. Thus, the rod member 1 imparts a different degree of stiffness to the ski 3 at each of its rotational positions as it is turned 360° about its longitudinal axis. This offers the skier a much wider and more subtle range of stiffness adjustments than prior art approaches such as Vogel which repeats itself every 180° (i.e., the stiffness characteristics exhibited by Vogel's element as it is rotated from 0° to 180° are the same as those exhibited when it is rotated from 180° to 360°). Further, when more than one rod member 1 is used, the stiffness of the ski can be adjusted both lengthwise and crosswise to tailor-make its stiffness to a particular skier's physical characteristics (e.g., weight distribution, boot cant, strength distribution) and style.

FIG. 5 illustrates a second indicating means which can be used for each rod member 1 and bore 5. This indicating means includes a substantially linear series of slots 27 extending interiorly of the ski 3 into fluid communication with the bore 5 and a series of markings or dots 29 on the rod member 1. The two series intersect at an angle whereby at lease one of the slots 27 and markings or dots 29 align as the rod member 1 is rotated within the bore 5 to indicate the rotational position of the rod member 1 within the bore 5. The slots can be numbered if desired and the markings or dots 29 can extend about any angular portion of the rod member 1 up to 360° if desired. In the indicating means of FIG. 5, the markings or dots 29 extend angularly about the rod member 1 for 180° with 0° indicating that the convex section 7 is facing upwardly and the ski 3 is at its stiffest. As the markings or dots 29 progressively align with the slots 27 above the bottom one in FIG. 5, the ski 3 becomes softer until eventually the mark or dot 29 that is 180° away from the 0° mark or dot 29 aligns with the top slot 27 and the ski 3 is at its softest.

The preferred embodiments of the invention use prestressed, curved rod members 1 which are solid; however, prestressed, curved rod members 1′ that are hollow can also be used as illustrated in FIGS. 8 and 9. Rod members 1 and 1′ can be used separately if desired but the preferred use of the hollow rod members 1′ is in combination with the solid rod members 1 as shown in FIGS. 8 and 9. In this embodiment, each of the rod members 1 and 1′ can be individually rotated about its longitudinal axis to vary the stiffness of the ski 3. The solid rod member 1 has slot 19 for turning and the hollow rod member 1′ has slots 19′ for turning.

The rod members 1 and 1′ together or separately can be placed in the bores 5 in the relatively flat, elongated main body portion of the ski 3 as illustrated in FIGS. 1–4 or can be placed atop this main body portion 31 as illustrated in FIG. 10. In this embodiment, clamps 33 and rod member 1′ form a second portion of the ski 3 and the clamps 33 are spaced lengthwise along the main body portion 31. Rod members 1 and 1′ are secured by the clamps 33 against the main body portion 31 and the stiffness of the ski 3 can be selectively adjusted by rotating members 1 and 1′ about their longitudinal axes. In this embodiment as in all of the embodiments, rod members 1 and 1′ can be used individually or together if desired. Rod member 1′ in FIG. 10 can also be replaced with a straight, hollow member if preferred or a series of closely spaced clamps 33 could be used alone to define the bore for rod members 1 or 1′.

FIG. 11 illustrates an adjustable stiffness unit 35 (solid lines) which can be inserted in the ski 3 (dotted lines). The unit 35 has a housing 37 with bores 5′ into which the rod members 1 (1′ or 1 and 1′) can be inserted. The rod members 1 have turning slots 19 for coacting with a screwdriver or other rotating tool. Set screws 21′ can be provided for selectively securing each rod member 1 in any one of its rotational positions. Indicating means including the markings or dots 23′ on the housing 37 and arrowheads 25 on the turning slots 19 can also be provided to indicate the rotational position of each rod member 1. The adjustable stiffness unit 35 as is the case with all embodiments of the present invention can be used with any flexible body and can be positioned within or adjacent the flexible body as desired.

Figure 12:
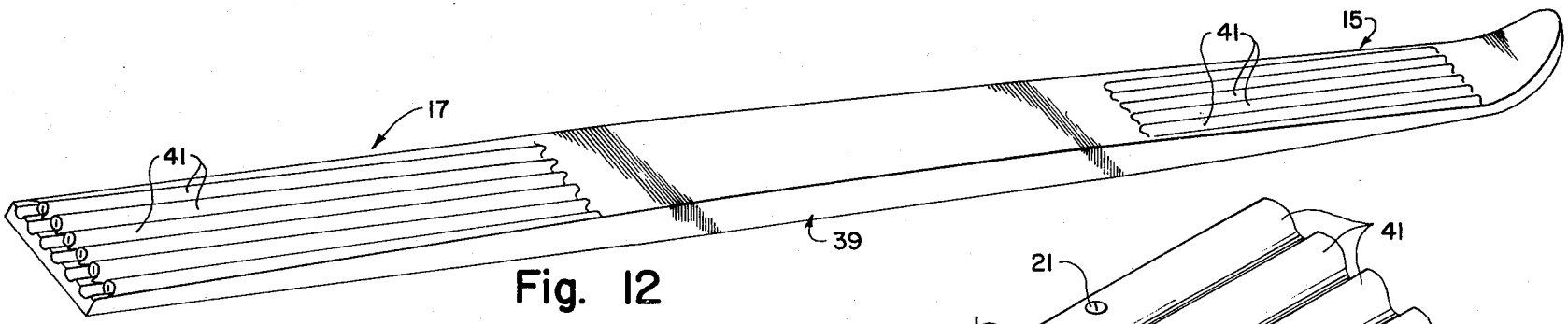
FIG. 12 is a perspective view of an embodiment of the invention in which the rod members are of uniform diameter along their lengths and since the ski thickness narrows at the tail and tip, the upper outlines of the tubes receiving the rod members are visible at the tail and tip portions of the ski.
Figure 13:
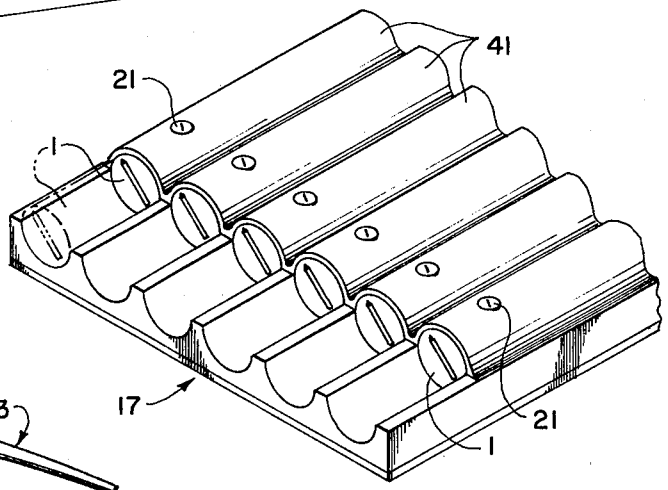
FIG. 13 is an enlarged, perspective view of the ski tail of FIG. 12.
Figure 14:
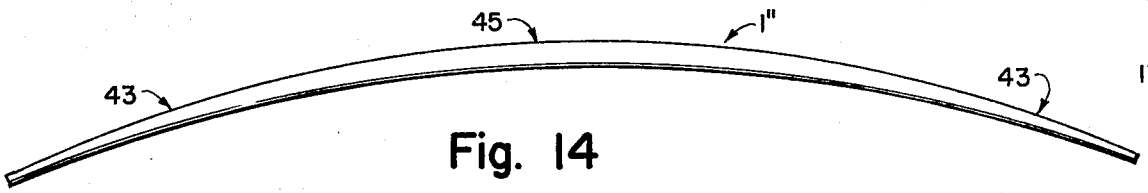
FIG. 14 is a side view of a modified, prestressed, curved rod member of the invention in which the thickness of the rod member increases from each end of the rod member toward the center thereof.
Figure 15:
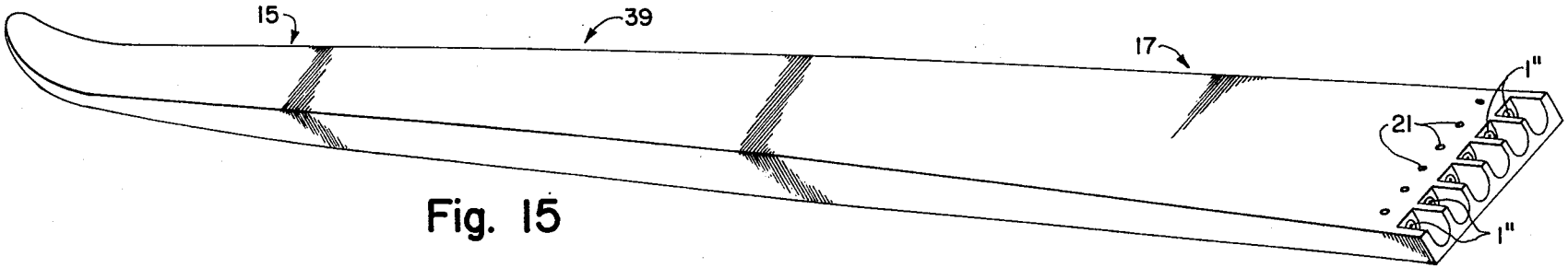
FIG. 15 illustrates the use of the rod members of FIG. 14 in the ski whereby the tapering end portions of the rod members enable them to be fitted in the ski without the ski having the ridged or ruffled appearance of FIG. 12. When the tapering rod members of FIG. 14 are used, they are permanently affixed in the ski and cannot be removed as is the case with the rod members of FIGS. 6 and 8.

In manufacture, the bores 5 of the embodiments of FIGS. 1–4 can be drilled into existing skis or can be originally built into them by placing straight tubes in the ski as it is being constructed to define the bores. Since the thickness of most skis 39 narrows at the tip and tail as illustrated in FIG. 12, it is contemplated that the upper outline of such straight tubes 41 which would be built into the main body of the ski 39 to receive the rod members would be visible at the tip 15 and tail 17 portions of the ski 39 forming a ridged or ruffled appearance. FIG. 13 shows this ridge or ruffled appearance in the tail portion 17 of the ski 39 and also illustrates in dotted lines that the ends of the rod members can extend rearwardly to be flush with the tail end of the ski. Another contemplated design for the rod members is illustrated in FIG. 14. This rod member 1″ has tapering end portions 43 so that the thickness and cross-sectional area of the rod member 1″ increases from each end thereof toward the center portion 45 along the longitudinal axis of the rod member 1″. As is the case with rod member 1, a corresponding hollow rod member with tapering ends could be placed about the rod member 1″ or used by itself. It is contemplated that the rod design of FIG. 14 could be used in a typical ski such as 39 of FIG. 12 to avoid the ridged or ruffled appearance as illustrated in FIG. 15. Because these rod members 1″ taper towards each end, they would be permanently affixed in the ski and could not be removed as is the case with the rod members of FIGS. 6 and 8. It is also contemplated that the unit 35 of FIG. 11 could be built into a ski or the ski could be drilled out to receive it and any of the rod member designs used with it.

The cross-sectional shapes of the prestressed rod members of this invention are preferably circular so that they can be rotated about their longitudinal axes; however, they could be non-rotational and have cross-sectional shapes that were, for example, square or rectangular. To adjust the stiffness of the non-rotatable embodiment, rod members of differing stiffness would have to be substituted in the bores. In all of the preferred embodiments illustrated, the rod members 1–1″ extend lengthwise of the flexible body because it is a ski but they could be positioned crosswise if desired as, for example, in a diving board. They could also be both crosswise and lengthwise, diagonally, or at any desired position relative to the flexible body. The invention is adaptable to any flexible body such as golf clubs, fishing rods, vaulting poles, and ski poles. The strength of each rod member 1–1″ can vary; however, it is anticipated in one embodiment that the weight needed to be applied at the top of the arch in FIGS. 6, 8 and 14 to straighten the rod member would be about 1200 grams and about 100 grams would be needed to be applied in the opposite direction to increase the curvature of the rod member. A contemplated embodiment would have the force of the prestressed, curved rod member 1–1″ vary along its longitudinal axis. In this manner, the force could increase progressively along the longitudinal axis so that, for example, the tail 17 of the ski was always stiffer than the tip 15. The force could also increase in a first direction along one portion of the longitudinal axis (e.g., from the middle of the ski toward the tip 15) and decrease in this same first direction along another portion of the longitudinal axis (from the tail 17 to the middle of the ski 3). Likewise, the force of the rod member 1–1″ could decrease from the tail 17 of the ski 3 to the middle and then increase from there to the tip 15. The force could also increase and decrease several times along the length of the rod member 1–1″ so that, for example, the stiffness of the ski decreased from the tail 17 for a few inches toward the middle of the ski 3, then increased past the middle, and finally decreased toward the tip 15.

The preferred method and apparatus of the present invention involves selectively adjusting the stiffness of a flexible body such as a ski which has an inherent stiffness. This inherent stiffness need not be very great and the present invention can be used to supply the entire stiffness characteristics to an otherwise limp body. In the preferred embodiments, there is at least one bore extending lengthwise substantially through the ski as illustrated in FIGS. 1–4; however, the bore can be defined by a member such as 1′ that extends adjacent the main body 31 of the ski as shown in FIG. 10 or a housing 37 which has at least one bore wherein the housing and extends within the ski as illustrated in FIG. 11 or adjacent thereto. The method involves inserting a prestressed, curved rod member into at least one bore and rotating the rod member within the bore to adjust the stiffness of the ski within predetermined limits. The method also includes selectively securing the rod member against rotation within the bore, indicating the rotational position of the rod member within the bore, varying the force of the prestressed, curved rod member along its length, inserting a prestressed, curved hollow rod member in the bore and individually rotating the hollow rod member and the other rod member to adjust the stiffness of the ski, and providing a plurality of bores extending along the length of the ski into which a plurality of prestressed, curved rod members are inserted.

While several embodiments of the present invention have been described in detail herein, various changes and modifications can be made without departing from the scope of the invention.

I claim:

1. In a flexible body such as a ski having at least one bore with a substantially circular cross section extending substantially therethrough, the improvement including:

means for adjusting the stiffness of said ski, said adjusting means including at least one prestressed, curved rod member received within said at least one bore, said rod member having a substantially circular cross section and a longitudinal axis and being rotatably received within said bore whereby the stiffness of said ski can be selectively adjusted by rotating the rod member within said bore about said longitudinal axis to any one of a number of rotational positions and, means for indicating the rotational position of said rod member within said bore, said indicating means including a series of slots, each of said slots extending interiorly of said ski into fluid communication with said bore, said indicating means further including a series of markings on said rod member, said series of slots and said series of markings intersecting whereby at least one of said slots and at least one of said markings align as said rod member is rotated within said bore to indicate the rotational position of said rod member within said bore.

2. In a flexible body such as a ski having at least one bore extending substantially therethrough, the improvement including:

means for adjusting the stiffness of said ski, said adjusting means including at least one prestressed, curved rod member received within said at least one bore, said rod member being solid and said improvement further including a prestressed, curved hollow rod member rotatably received in said bore, said solid rod member being rotatably received in said hollow rod member whereby the stiffness of the ski can be adjusted by individually rotating said solid and said hollow rod members.

3. An adjustable stiffness unit for use with a flexible body such as a ski to selectively alter the stiffness of said ski, said unit comprising:

housing means, said housing means containing a plurality of bores with substantially circular cross sections extending substantially therethrough, said housing means being positioned along said ski, rod means including a plurality of prestressed, curved rod members received within said bores, said rod members having substantially circular cross sections and each of said rod members having a longitudinal axis and being respectively rotatably received within one of said bores whereby the stiffness of said unit and said ski along the lengths thereof and transverse to the lengths can be adjusted by selectively rotating each of the rod members within said bores about said respective longitudinal axes to any one of a number of positions, and, means for indicating the rotational position of said plurality of rod members within the respective bores, said indicating means including a series of slots associated with each bore and a series of markings on each rod member, each of said slots in a respective series extending interiorly of said ski and said housing into fluid communication with the respective bore, said series of slots for each respective bore intersecting the series of markings on the rod member within said respective bore whereby at least one of said slots in each series and at least one of said markings in each series align as said rod member is rotated within said bore to indicate the rotational position of said rod member within said respective bore.

4. A method for adjusting the stiffness of a flexible body such as a ski having at least one bore extending substantially therethrough, the method comprising the steps of:

(a) inserting a prestressed, curved rod member into said bore, (b) rotating said rod member within said bore to adjust the stiffness of said ski within predetermined limits, (c) inserting a prestressed, curved hollow rod member in said bore about said rod member, and, (d) individually rotating said hollow rod member and said rod member within said bore to adjust the stiffness of said ski.

5. In a flexible body such as a ski having at least one bore with a substantially circular cross section extending substantially therethrough, the improvement including:

means for adjusting the stiffness of said ski, said adjusting means including at least one rod member having a longitudinal axis and a substantially circular cross section and being rotatably received within said bore for rotation about said longitudinal axis in at least a first rotational direction through an arc of substantially 360° to any one of a number of different rotational positions along said arc, said rod member being prestressed into a curved shape whereby the stiffness of said ski can be selectively adjusted by rotating the rod member within said bore in said first rotational direction about said longitudinal axis and whereby a different degree of stiffness is imparted to said ski at every rotational position of said prestressed, curved rod member along said arc.

6. The improvement of claim 5 wherein said ski has forward and rearward ends and said bore extends along the length of said ski, said bore and said rod member having first and second ends, said second end of said rod member being visible and accessible from the rearward end of said ski when in said bore, said rearward end of said ski having at least one marking positioned adjacent the second end of said bore and said second end of said rod member having at least one marking whereby the rotational position of said rod member within said bore along said arc can be determined by reference to the relative positions of said markings.

7. The improvement of claim 5 wherein the force of said prestressed, curved rod member varies along said longitudinal axis.

8. The improvement of claim 5 further including a plurality of bores extending along the length of said ski and a plurality of prestressed, curved rod members received respectively in said bores, said bores and said rod members having substantially circular cross sections, each of said rod members having a longitudinal axis and being rotatably received within each respective bore for rotation about said respective longitudinal axis in at least a first rotational direction through an arc of substantially 360° to any one of a number of rotational positions along said arc whereby each prestressed, curved rod member imparts a different degree of stiffness to said ski at every rotational position along said arc and whereby the stiffness of said ski along the length of the ski and transverse of the length of the ski can be adjusted by selectively rotating each of said rod members within said bores.

9. A method for adjusting the stiffness of a flexible body such as a ski having at least one bore with a substantially circular cross section extending substantially therethrough, the method comprising the steps of:

(a) inserting a prestressed, curved rod member having a longitudinal axis and a substantially circular cross section into said bore, and, (b) rotating said prestressed, curved rod member within said bore in a first rotational direction about said longitudinal axis along an arc of substantially 360° to any one of a number of different rotational positions to impart a different degree of stiffness to said ski at every rotational position of said prestressed, curved rod member along said arc.

10. The method of claim 9 further including the step of:

(c) indicating the rotational position of said rod member along said arc.

* * * * *